US011854412B2

(12) United States Patent
Kozler et al.

(10) Patent No.: US 11,854,412 B2
(45) **Date of Patent: *Dec. 26, 2023**

(54) VERIFICATION OF UNMANNED AERIAL VEHICLE ADS-B RECEIVER OPERABILITY

(71) Applicant: WING Aviation LLC, Mountain View, CA (US)

(72) Inventors: Shirley Kozler, San Jose, CA (US); Brandon L. Jones, Redwood City, CA (US)

(73) Assignee: WING Aviation LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/104,994

(22) Filed: Feb. 2, 2023

(65) Prior Publication Data

US 2023/0186777 A1 Jun. 15, 2023

Related U.S. Application Data

(63) Continuation of application No. 16/984,751, filed on Aug. 4, 2020, now Pat. No. 11,600,186.

(51) Int. Cl.
*G08G 5/00* (2006.01)

(52) U.S. Cl.
CPC ..... *G08G 5/0043* (2013.01); *G08G 5/003* (2013.01); *G08G 5/006* (2013.01); *G08G 5/0013* (2013.01);
(Continued)

(58) Field of Classification Search
CPC .... G08G 5/0043; G08G 5/0013; G08G 5/003; G08G 5/006; G08G 5/0069; G08G 5/0082; G08G 5/0026; G08G 5/0078
See application file for complete search history.

(56) References Cited

U.S. PATENT DOCUMENTS 9,964,951 B1 5/2018 Dunn et al.
2016/0054451 A1 2/2016 Fukami et al.
(Continued)

FOREIGN PATENT DOCUMENTS

EP 2894623 A1 7/2015
EP 3154046 A1 4/2017
EP 3667253 A1 6/2020

OTHER PUBLICATIONS

"Automatic Dependent Surveillance-Broadcast (ADS-B) Out Performance Requirements to Support Air Traffic Control (ATC) Service; Final Rule", Part III, Department of Transportation, Federal Aviation Administration, 14 CFR Part 91, 37 pages.
(Continued)

*Primary Examiner* — Shon G Foley
(74) *Attorney, Agent, or Firm* — CHRISTENSEN O'CONNOR JOHNSON KINDNESS PLLC

(57) ABSTRACT

In some embodiments, techniques are provided for verifying operability of an automatic dependent surveillance-broadcast (ADS-B) receiver included in a first unmanned aerial vehicle (UAV), which includes receiving ADS-B data representative of ADS-B messages broadcast by traffic within a reception range of the ADS-B receiver during a first period of time, estimating a traffic environment for a service area spanning, at least in part, a first operating area of the first UAV during the first period of time, determining an expected observed traffic of the first UAV during the first period of time based on the estimated traffic environment, and verifying operability of the ADS-B receiver of the first UAV based on a comparison between the expected observed traffic of the first UAV and the traffic associated with the ADS-B data received by the ADS-B receiver of the first UAV.

17 Claims, 4 Drawing Sheets

(52) U.S. Cl.
CPC ..... *G08G 5/0069* (2013.01); *G08G 5/0082* (2013.01)

(56) References Cited

U.S. PATENT DOCUMENTS

| | | | |
|---|---|---|---|
| 2018/0350246 | A1 | 12/2018 | Burgess et al. |
| 2018/0352375 | A1 | 12/2018 | Burgess et al. |
| 2019/0281483 | A1 | 9/2019 | Chalmer et al. |
| 2022/0351632 | A1 | 3/2022 | Bush |

OTHER PUBLICATIONS

"ADS-B Implementation and Operations Guidance Document", International Civil Aviation Organization Asia and Pacific Office, Appendix K to the Report, Edition 11.0—Jul. 2018, 126 pages.
International Search Report and Written Opinion, dated Nov. 4, 2021, in corresponding International Patent Application No. PCT/US2021/042364, 13 pages.

VERIFICATION OF UNMANNED AERIAL VEHICLE ADS-B RECEIVER OPERABILITY

CROSS-REFERENCE TO RELATED APPLICATION

This application is a continuation of U.S. application Ser. No. 16/984,751, filed on Aug. 4, 2020, the contents of which are incorporated herein by reference.

TECHNICAL FIELD

This disclosure relates generally to Automatic Dependent Surveillance-Broadcast (ADS-B) receivers, and in particular but not exclusively, relates to operability verification of ADS-B In receivers of unmanned aerial vehicles (UAVs).

BACKGROUND INFORMATION

Automatic Dependent Surveillance-Broadcast (ADS-B) is a satellite-derived aircraft location system that combines an aircraft's positioning source, aircraft avionics, and ground infrastructure to create an accurate surveillance interface between aircrafts and air traffic control. ADS-B equipment is broadly categorized as ADS-B Out and ADS-B In, which respectively correspond to the capability to output and receive ADS-B data. Aircraft equipped with ADS-B Out transponders, for example, are capable of broadcasting ADS-B data indicative of aircraft position, altitude, and velocity vector at rates greater than traditional radar-based surveillance systems to enable accurate, real-time, and dynamic tracking of the broadcasting aircraft.

ADS-B data may be of particular importance to unmanned aerial vehicles (UAVs), which are becoming increasingly popular in general and provide opportunities for transportation of goods between physical locations (e.g., from retailer to consumer). A UAV is a vehicle capable of travel without a physically-present human operator that may be capable of operating, at least partially, autonomously. When a UAV operates in a remote-control mode, a pilot or driver that is at a remote location can control the UAV via commands that are sent to the UAV via a wireless link. When the UAV operates in an autonomous mode, the unmanned vehicle typically moves based on pre-programmed navigation waypoints, dynamic automation systems, or a combination thereof. Further, some unmanned vehicles can operate in both a remote-control mode and an autonomous mode, and in some instances may do so simultaneously. For instance, a remote pilot or driver may wish to leave navigation to an autonomous system while manually performing another task.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Figure 1:
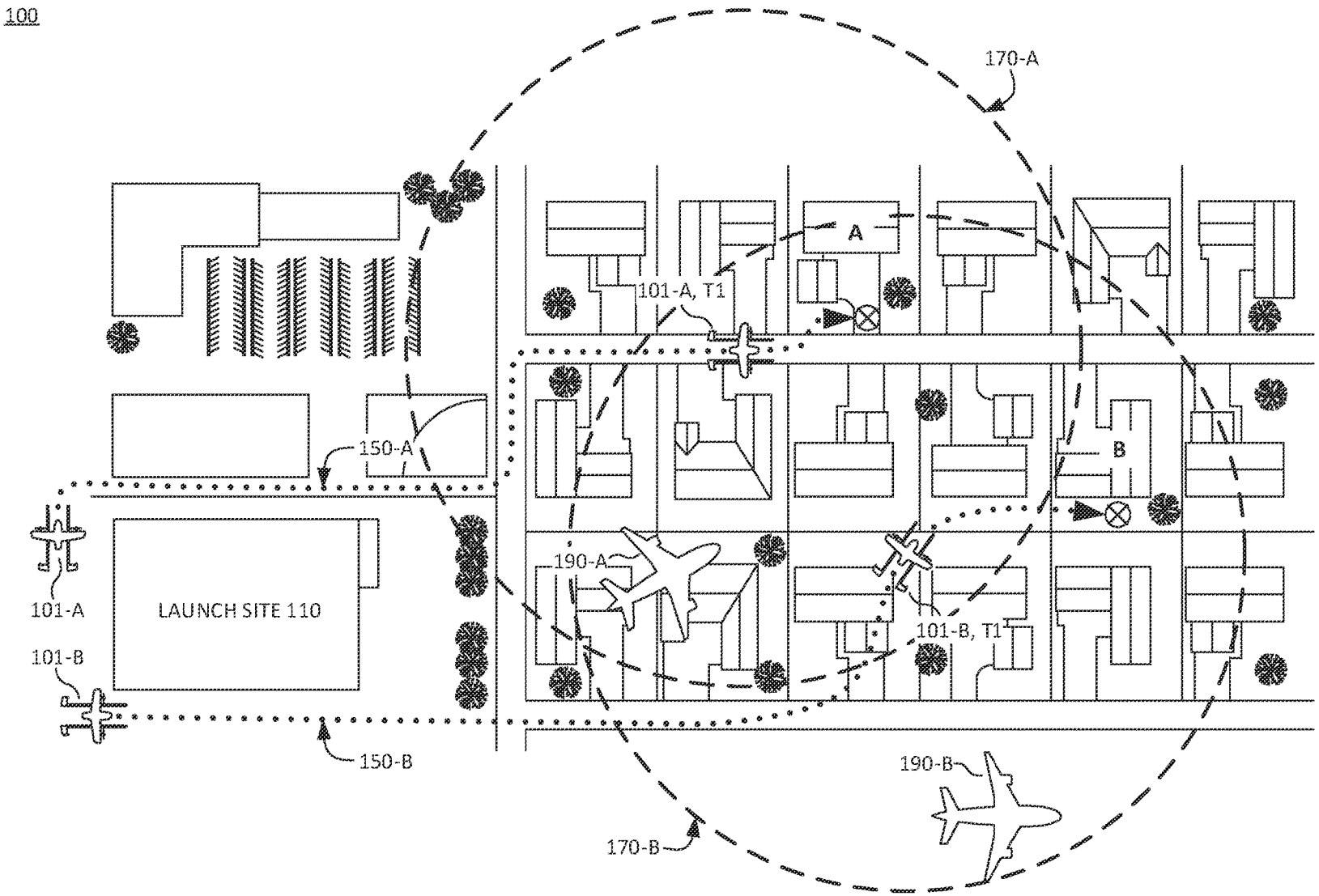
FIG. 1 illustrates an aerial map of a geographic area at an instance of time, in accordance with an embodiment of the disclosure.

Embodiments of a system, apparatus, and method for verification of unmanned aerial vehicle ADS-B receiver operability are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Some portions of the detailed description that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "receiving", "providing", "estimating", "determining", "verifying", "combining", "segmenting", "generating", "identifying", "flagging", "adjusting", "mapping", "displaying", "aborting", or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such as information storage, transmission, or display devices.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, embodiments of the present disclosure are not described with reference to any particular programming language. It will be appreciated that a variety of programming languages may be used to implement the teachings of the disclosure as described herein.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

FIG. 1 illustrates an aerial map 100 of a geographic area at an instance of time, in accordance with an embodiment of the disclosure. Aerial map 100 illustrates a portion of a service area (e.g., a pre-determined geographic area) of a drone delivery service in which a plurality of UAVs 101 operates within and provides transportation and delivery of goods between different locations in a semi-autonomous or fully autonomous manner. Each of the plurality of UAVs may be equipped with an ADS-B receiver capable of receiving ADS-B messages broadcast by nearby aircraft (e.g., manned aircraft or other aircraft equipped with an ADS-B out transponder such as aircrafts 190-A and 190-B) within a reception range (e.g. 170-A for first UAV 101-A at time T1 and 170-B for second UAV 101-B at time T1) of a given UAV, which may be used for traffic and/or collision avoidance between the given UAV included in the plurality of UAVs 101 and the aircraft 190. For example, when the ADS-B messages received by one of the plurality of UAVs indicates aircraft 190 is less than a threshold distance away from the UAV 101, then the UAV 101 may adjust a flight path, land, or otherwise alter course to maintain at least a threshold distance between the UAV 101 and the aircraft 190.

Aircraft 190 with ADS-B out capabilities may broadcast ADS-B messages (e.g., containing unique identifier, latitude, longitude, altitude, speed, velocity vector, or the like) automatically at a pre-determined rate (e.g., once per second) and at a pre-determined radio frequency (e.g., 1090 MHz or 968 MHz) to notify aircraft (e.g., any one of the plurality of UAVs 101) within a reception range (e.g., 200 nautical miles, but also dependent on a geography of the service area) of their position information in substantially real-time. For example, at time T1 in the illustrated embodiment, first UAV 101-A is in process of delivering a parcel from launch site 110 to a driveway of property A along flight path 150-A while second UAV 101-B is in process of delivery a parcel from launch site 110 to a backyard of property B along flight path 150-B. At the time of T1, first UAV 101-A may receive ADS-B messages from aircraft 190-A, but not aircraft 190-B since aircraft 190-B is out of a reception range 170-A of the ADS-B receiver of the first UAV 101-A. However, second UAV 101-B receives ADS-B messages via an ADS-B receiver for both aircrafts 190-A and 190-B since both aircrafts are within a reception range 170-B of the second UAV 101-B at time T1. As discussed above, the ADS-B messages may provide critical information related to nearby aircraft positions, which may be utilized by the plurality of UAVs 101 to ensure safe operation.

In some embodiments the ADS-B receivers of one or more of the plurality of UAVs 101 may be ADS-B In only receivers (e.g., capable of receiving ADS-B messages but not capable of transmitting ADS-B messages) or may otherwise operate in an ADS-B receive only state (e.g., to avoid saturation of the ADS-B frequencies). As the ADS-B receivers may be expected to be operational throughout a lifetime of the plurality of UAVs 101, an automated and real-time health check may be desirable to ensure each of the UAVs is receiving ADS-B messages from nearby traffic reliably. Advantageously, regular health checks of the plurality of UAVs enable timely identification, repair, replacement, and/or calibration of a defective ADS-B receiver, antenna coupled to the ADS-B receiver, or other defective component associated with the ADS-B receiver. However, for the UAVs unable to broadcast ADS-B messages, verifying operability of their ADS-B receivers is less than straightforward since a transmit-receive self-test may not be available or desired.

Described herein are embodiments of a real-time monitor capable of verifying operability of the ADS-B receivers for each of the plurality of UAVs 101 by collating ADS-B In data received by the plurality of UAVs 101 and/or cross-checking operability with other known "truth" sources of ADS-B reported traffic within the service area of the plurality of UAVs 101 to provide a low-cost and real-time health monitoring solution for the UAV fleet. Health monitoring may be performed continuously, periodically, and at any stage of UAV operation (e.g., as a pre-flight health check, an in-flight health check, and/or a post-flight health check).

It is appreciated that the real-time health monitor may be performed for any vehicle with an ADS-B receiver including any number of UAVs (e.g., first UAV 101-A and second UAV 101-B), manned aircraft, or other vehicle operating within a service area. It is further appreciated that the illustrated aerial view 100 is scaled for the sake of discussion (e.g., to show overlapping and non-overlapping portions of reception range 170 of the plurality of UAV 101 with respect the illustrated geometric area and aircraft 190) and should not be deemed limiting. Additionally, it is noted that the real-time health monitor is not necessarily limited to a drone delivery service and may be equally applicable to any situation in which ADS-B operability verification is desired.

Figure 2:
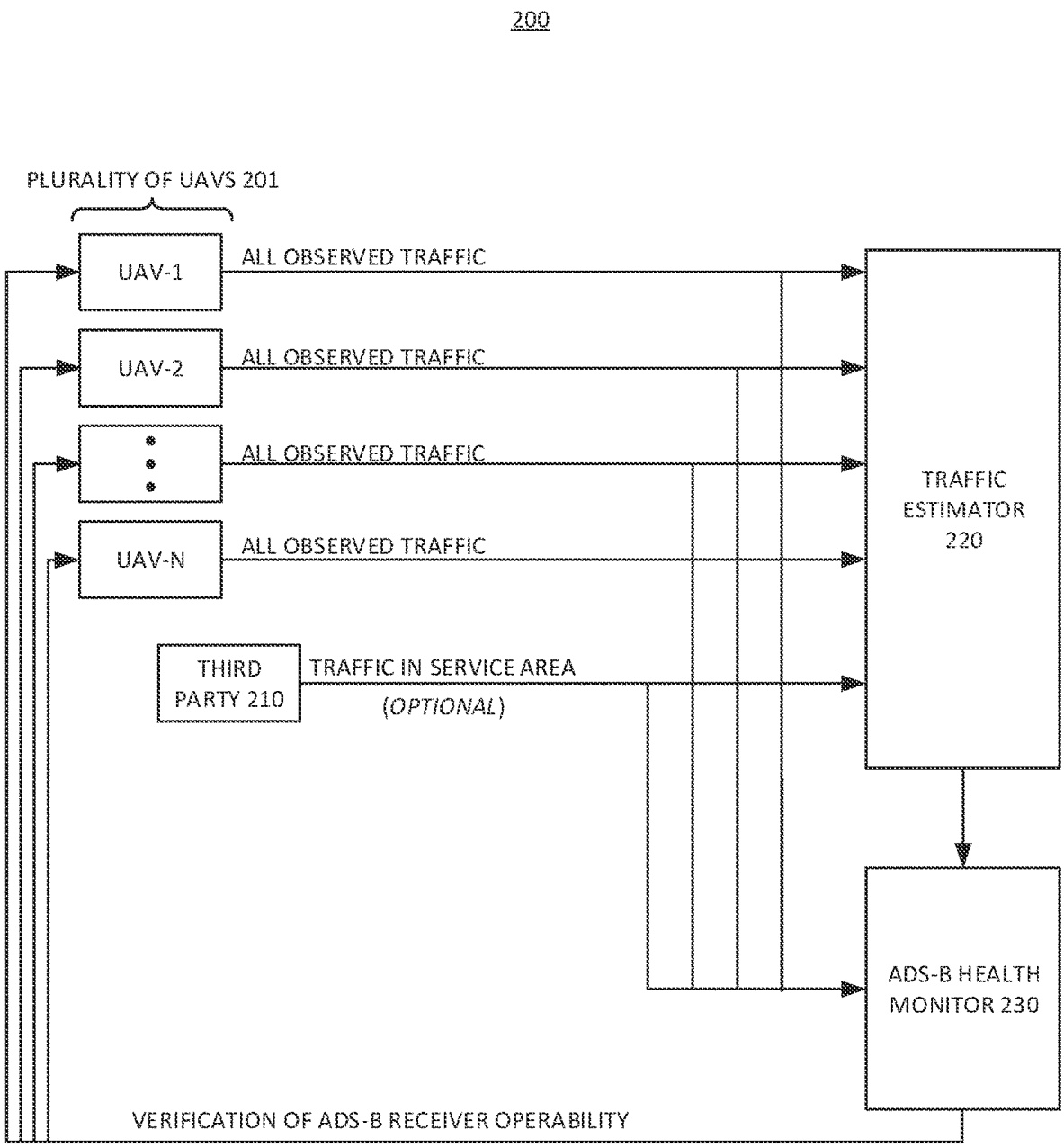
FIG. 2 illustrates a flow chart for continuously monitoring ADS-B receivers of a plurality of UAVs via a traffic estimator and an ADS-B health monitor, in accordance with an embodiment of the disclosure.

FIG. 2 illustrates a flow chart 200 for continuously monitoring ADS-B receivers of a plurality of UAVs 201 (e.g., a first UAV-1, a second UAV-2, and up to any number, N, of UAVs) via a traffic estimator 220, an ADS-B health monitor 230, and optionally third party data 210, in accordance with an embodiment of the disclosure. The order in which some or all of the process blocks appear in flow chart 200 should not be deemed limiting. Rather, one of ordinary skill in the art having the benefit of the present disclosure will understand that some of the process blocks may be executed in a variety of orders not illustrated, or even in parallel. Furthermore, several of the processing blocks depict steps that are optional and may be omitted.

Figure 4:
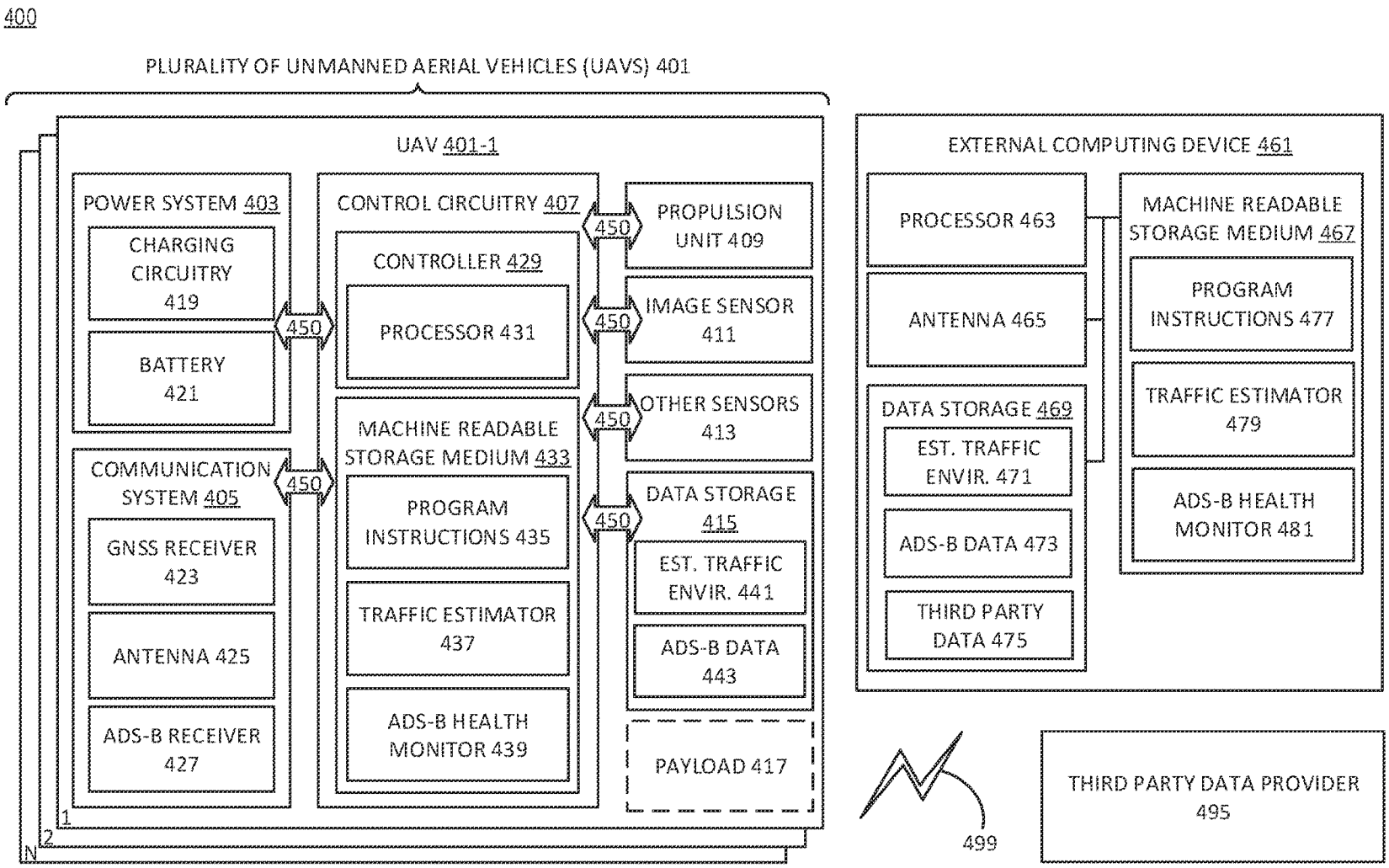
FIG. 4 illustrates a functional block diagram of a computing system including a plurality of UAVs, an external computing device, and a third party data provider, in accordance with an embodiment of the disclosure.

The traffic estimator 220 and ADS-B health monitor 230 may correspond to one or more algorithms or instruction sets stored in a computer-readable or machine-readable medium, which in some embodiments may be disposed in or otherwise represented by logic or circuitry of a computing system (see infra, FIG. 4). The computing system may be a distributed system and thus the algorithms or instruction sets corresponding to the traffic estimator 220 and ADS-B health monitor 230 may be distributed in memory or as other circuitry throughout the plurality of UAVs 201, external computing resources (e.g., one or more processing systems managing the plurality of UAVs 201), and the like.

In the illustrated embodiment, the plurality of UAVs 201 is collectively operating within a service area (e.g., to delivery and/or transport goods between different locations) during a first period of time (e.g., including, as illustrated in FIG. 1, a particular instance of time). It is appreciated that each UAV included in the plurality of UAVs 201 may be operating in respective operating areas (e.g., a first operating area for a first UAV included in the plurality of UAVs 201) that do not necessarily span the entirety of the service area. For example, a given UAV included in the plurality of UAVs may make a plurality of trips and/or stops that may only cover only a portion of the service area. In other words, the service area of the plurality of UAVs 201 overlaps, at least in part, with the operating area of each of the plurality of UAVs 201.

During the first period of time (e.g., any temporal duration), nearby aircraft may broadcast ADS-B messages indicative of the unique identifier, altitude, longitude, latitude, speed (e.g., velocity vector), local time, and other positional, temporal, or status information of the nearby aircraft. Each of the plurality of UAVs 201 include a respective ADS-B receiver (e.g., an ADS-B In only receiver) to receive the ADS-B messages broadcast by any of the nearby aircraft within a reception range of the ADS-B receiver. The received ADS-B messages may be logged (e.g., stored in memory) by the recipient UAV as ADS-B data that is representative of observed traffic seen during the first period of time. It is noted that each of the plurality of UAVs 201 do not necessarily need to be in flight to receive and record ADS-B messages of nearby aircraft (e.g., ADS-B messages may be logged even when a given UAV is idle between trips or otherwise not actively in flight).

As illustrated, each of the plurality of UAVs 201 may send the ADS-B data to the traffic estimator 220 (e.g., via a wired or wireless connection). More specifically, the traffic estimator 220 receives ADS-B data segmented into different tracks of observed traffic that are representative of ADS-B messages received, respectively, by the plurality of UAVs 201. For example, ADS-B data obtained by first UAV-1 may correspond to a first track of the different tracks of observed traffic and is representative of ADS-B messages broadcast by traffic within a reception range of the ADS-B receiver of the first UAV-1 during the first period of time. Additional traffic data different from the ADS-B data of the first UAV-1 may also be transmitted to the traffic estimator 220. The additional data may correspond to additional ADS-B data (e.g., different tracks of observed traffic obtained by the ADS-B receivers of UAV-2 through UAV-N) and/or aggregated third party aggregated ADS-B data (e.g., ADS-B messages broadcast within the service area and aggregated by third party service providers such as Flightradar24 by Flightradar24 AB, OpenSky Network by OpenSky Network Association, or the like). In some embodiments, each of the different tracks may be representative of an approximation of a traffic environment for the service area during the first period of time based solely on the received ADS-B messages of the respective UAV. However, each of the different tracks of observed traffic may not necessarily be identical even if each of the plurality of UAVs 201 has fully functional ADS-B receivers. For example, differences in operating areas between UAVs operating in the same service area may result in different traffic observations. Accordingly, traffic estimator 220 receives and collates or otherwise combines the observed traffic from the plurality of UAVs 201 and generates a unified traffic environment (e.g., a singular estimate of the traffic environment).

In response to receiving the observed traffic data (e.g., ADS-B data from UAV-1, additional ADS-B data from UAV-2 through N, and/or third party aggregated ADS-B data), the traffic estimator 220 estimates a traffic environment for the service area of the plurality of UAVs based, at least in part on the ADS-B data obtained from the first UAV-1 and the additional data. In some embodiments, the different tracks of observed traffic may be combined to generate the singular estimate of the traffic environment during the first period of time using thresholding, a probabilistic Bayesian estimator, combinations thereof, or otherwise. In one embodiment, thresholding matching may correspond to identifying common aircrafts observed by a threshold number or percentage (e.g., greater than 50%, greater than 70%, greater than 90% or otherwise) of the plurality of UAVs 201 at one or more instances of time during the first period of time. For example, if the ADS-B data indicated that 7 of 10 UAVs included in the plurality of UAVs 201 observed an aircraft with a first identifier at first instance of time during the first period of time (e.g., the observed percentage is greater than a threshold percentage), then the singular estimate of the traffic environment may determine that there is an aircraft with the first identifier at the first instance of time. This process may be repeated by the traffic estimator 220 for any number of instances of time within the first period of time to generate the singular estimate of the traffic environment.

In the same or other embodiments, the traffic estimator 220 may utilize the probabilistic Bayesian estimator to generate the singular estimate. The probabilistic Bayesian estimator may correspond to a Kalman Filter, an Extended Kalman Filter, an Unscented Kalman Filter, or other type of data fusion algorithm to fuse the different tracks of ADS-B data into the singular estimate for the traffic environment.

In some embodiments, the traffic estimator 220 compares the estimated traffic environment (e.g., the singular estimate) to third party aggregated ADS-B data received from the third party 210 to verify accuracy of the estimated traffic environment. For example, speed, altitude, latitude, or longitude of aircraft within the estimated traffic environment at one or more instances of time within the first period of time may be compared or otherwise cross-checked with the third party aggregated ADS-B data. If there are significant differences between the estimated traffic environment and the third party aggregated ADS-B data then the estimated traffic environment may be flagged as potentially invalid.

It is appreciated that in some embodiments the estimated traffic environment may be generated in substantially real time and continuously updated (e.g., the observed traffic data may be streamed to the traffic estimator 220 as the plurality of UAVs 201 receives the ADS-B messages) to enable real-time monitoring of the ADS-B receivers of the plurality of UAVs 201. In other words, the estimated traffic environment may be continuously updated over time to incorporate ADS-B data as received.

As illustrated, the traffic estimator 220 transmits the estimated traffic environment to the ADS-B health monitor 230, which is configured to verify operability of the ADS-B receivers of the plurality of UAVs 201 based, at least in part, on the observed traffic of a given UAV (e.g., ADS-B data of the first UAV-1) and expected observed traffic determined based on the estimated traffic environment. For example, any aircraft included in the estimated traffic environment that has a location within a reception range of the ADS-B receiver as the first UAV-1 traverses through the service area along a flight path during the first period of time may be expected to be observed by the first UAV-1. The expected observed traffic of the first UAV may then be compared to the actual observed traffic according to the ADS-B data received by the first UAV-1 during the first period of time to verify whether or not the ADS-B receiver of the first UAV-1 is operating nominally. In some embodiments, the ADS-B health monitor 230 will provide continuous updates to the plurality of UAVs 201 indicating an operating state of the ADS-B receivers of the plurality of UAVs 201 (e.g., nominal or subnominal). For example, if the ADS-B receiver of any of the plurality of UAVs 201 is not operating nominally (e.g., subnominal) then the ADS-B health monitor 230 may send a signal indicative of the ADS-B receiver operability state.

Figure 3:
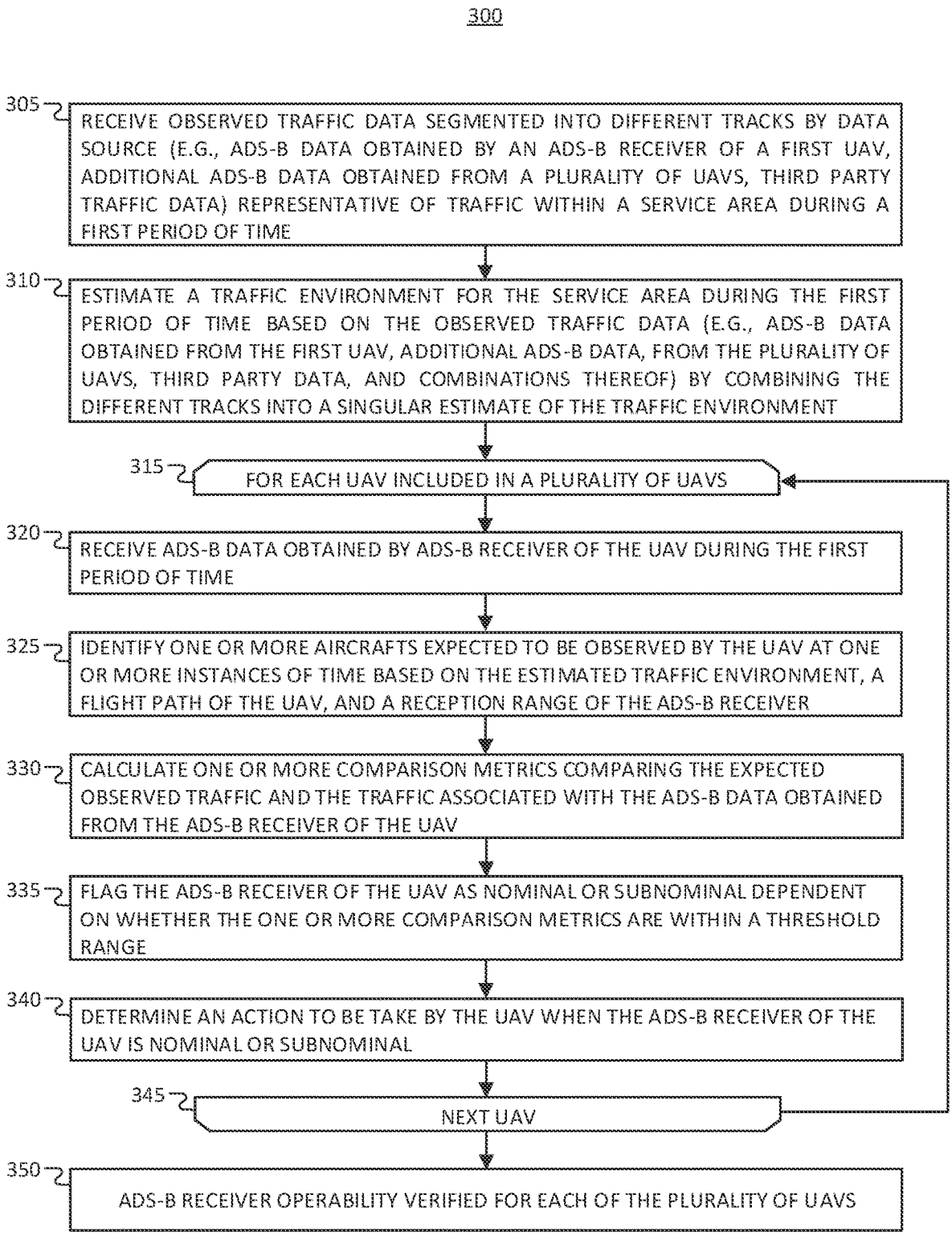
FIG. 3 illustrates a flow chart for verifying ADS-B operability with an ADS-B monitor, in accordance with an embodiment of the disclosure.

FIG. 3 illustrates a flow chart 300 for verifying ADS-B receiver operability with an ADS-B monitor, in accordance with an embodiment of the disclosure. Flow chart 300 is one possible implementation of a process performed by the traffic estimator 220 and ADS-B health monitor 230 of flow chart 200 illustrated in FIG. 2. For example, process blocks 305 and 310 of FIG. 3 may correspond to the traffic estimator 220 of FIG. 2 and process blocks 315-350 of FIG. 3 may correspond to the ADS-B health monitor 230 of FIG. 2. Referring back to FIG. 3, the order in which some or all of the process blocks appear in flow chart 300 should not be deemed limiting. Rather, one of ordinary skill in the art having the benefit of the present disclosure will understand that some of the process blocks may be executed in a variety of orders not illustrated, or even in parallel. Furthermore, several of the processing blocks depict steps that are optional and may be omitted.

Block 305 shows receiving observed traffic data representative of traffic within a service area during a first period of time. The observed traffic data is segmented into different tracks by data source. In some embodiments, the plurality of data sources may correspond to ADS-B data obtained by ADS-B receivers of respective UAVs included in a plurality of UAVs. For example, a first track included in the different track may correspond to ADS-B data obtained by an ADS-B receiver of a first UAV included in the plurality of UAVs. Additional ADS-B data obtained from a plurality of ADS-B receivers associated with a respective UAV included in the plurality of UAVs may also be included in the observed traffic data and segmented accordingly. In one embodiment, third party aggregated ADS-B data may also be received from a third party source.

Block 310 illustrates estimating a traffic environment for the service during the first period of time based on the observed traffic data by combining the different tracks into a singular estimate of the traffic environment. In one embodiment, the estimated traffic environment spans, at least in part, a first operating area of the first UAV. In the same or other embodiments, the estimated traffic environment is estimated based, at least in part, on ADS-B obtained by the first UAV and additional traffic data different from the ADS-B data obtained from the first UAV (e.g., the additional ADS-B data obtained from the plurality of UAVs, third party data, and combinations thereof). In some embodiments the observed traffic segmented into different tracks are combined or otherwise fused together using at least one of a probabilistic Bayesian estimator or threshold matching to generate the singular estimate of the traffic environment. In some embodiments, the probabilistic Bayesian estimator is a Kalman Filter, an Extended Kalman Filter, or an Unscented Kalman Filter.

Block 315 and 345 show a loop for monitoring the ADS-B receiver of each UAV included in a plurality of UAVs. Process blocks disposed between blocks 315 and 345 may include steps that an ADS-B health monitor utilizes to verify operability of an ADS-B receiver included in the UAV being monitored.

Block 320 illustrates receiving ADS-B data obtained by the ADS-B receiver of the UAV (e.g., a first UAV included in the plurality of UAVs) during the first period of time. The ADS-B data is representative of ADS-B messages broadcast by traffic within a reception range of the ADS-B receiver during the first period of time. However, it is appreciated that in some instances the ADS-B data obtained by the ADS-B receiver of the UAV may be a null value or otherwise indicate a lack of observed traffic during the first period of time (e.g., in situations where there is actually no observed traffic, the ADS-B receiver is operating subnominally, or otherwise).

Block 325 shows determining an expected observed traffic of the UAV (e.g., the first UAV) during the first period of time by identifying one or more aircraft expected to be observed by the UAV during the first period of time based on the estimated traffic environment, a flight path of the UAV, a reception range of the ADS-B receiver of the UAV, and combinations thereof. For example, at a first instance of time the flight path of the UAV may indicate a position of the UAV. Then, based on the estimated traffic environment, any aircraft located within a reception range of the ADS-B receiver with respect to the position of the UAV at the first instance of time may be expected to be observed by the UAV. In some embodiments, the process for identifying one or more aircrafts expected to be observed may be repeated for a plurality of instances of time to determine the expected observed traffic of the UAV over the entire duration of the first period of time.

Block 330 illustrates calculating one or more comparison metrics comparing the expected observed traffic (e.g., determined from process block 325) and the traffic associated with the ADS-B data obtained from the ADS-B receiver of the UAV. In one embodiment, the one or more comparison metrics include determining a difference between a total number of aircraft expected to be observed by the first UAV based on the one or more aircraft identified and an actual total number of aircraft observed based on the traffic associated with the ADS-B data of the UAV. In the same or another embodiment, the one or more comparison metrics includes determining a difference between an expected observation duration of each of the one or more aircraft identified from the estimated traffic environment and an actual observation duration of the one or more aircraft determined from the ADS-B data of the UAV.

Block 335 shows verifying operability of the ADS-B receiver (e.g., the first UAV) based on a comparison (e.g., the one or more comparison metrics) between the expected observed traffic of the UAV and the traffic associated with the ADS-B data received by the ADS-B receiver of the UAV. More specifically, the ADS-B receiver of the UAV may be flagged as nominal or subnominal depending on whether the one or more comparison metrics are within a threshold range. In one embodiment, a first aircraft expected to be observed by the UAV at a first time instance is identified based on the estimated traffic environment (e.g., as shown in block 325). In the same embodiment, the ADS-B receiver may be flagged as subnominal when the ADS-B data obtained by the UAV does not include an ADS-B message corresponding to the first aircraft at the first time instance. Conversely, the ADS-B receiver may be flagged as nominal when the ADS-B data obtained by the UAV does include an ADS-B message corresponding to the first aircraft at the first time instance.

In the same or other embodiments, the ADS-B receiver of the UAV is flagged as nominal when at least one of the one or more comparison metrics is within a threshold range or conversely the ADS-B receiver of the UAV is flagged as subnominal when at least one of the one or more comparison metrics is outside of the threshold range. In some embodiments where there are more than one of the one or more comparison metrics, a single instance of one of the one or more comparison metrics being outside of the threshold range may result in the ADS-B receiver of the UAV being flagged as subnominal. In some embodiments, the threshold range for the difference between an expected observation duration of each of the one or more aircraft identified from the estimated traffic environment and an actual observation duration of the one or more aircraft determined from the ADS-B data corresponds to a percentage difference (e.g., for each observed aircraft, the UAV actual observation duration is at least 50%, 70%, 90%, 95% or a different percentage of the expected observation duration). In the same or other embodiments the threshold range for the difference between the total number of aircraft expected to be observed by the UAV and the actual total number of aircraft observed is a threshold percentage (e.g., at least 50%, 70%, 90%, 95% or a different percentage of aircraft expected to be observed by the UAV were actually observed by the UAV during the first period of time). In some embodiments, there may be an upper limit of the percentage differences of the threshold ranges (e.g., not greater than 100%).

Block 340 illustrates determining an action to be taken to address the ADS-B receiver of the UAV being nominal or subnominal. In some embodiments, the action to be taken to address the ADS-B receiver of the UAV as being nominal may be to continue as scheduled (e.g., for delivery of a parcel or the like). In the same or other embodiments, verification of a nominal ADS-B may result in scheduling a next health check of the ADS-B receiver at a particular time or occurrence of an event (e.g., delivery of the package, landing of the UAV, or the like). In some embodiments, the action to be taken to address the ADS-B receiver of the UAV as being subnominal may include adjusting a flight path of the UAV. The flight path of the UAV may be adjusted to ensure a threshold distance is maintained from the identified aircraft, add a stop to a launch site or repair center for repairs, and/or immediately land the UAV. In some embodiments, the UAV may still complete delivery of the parcel before rerouting for repairs when the ADS-B receiver of the UAV is flagged as subnominal.

Block 345 shows the end of the terminal end of the loop initiated at block 315. It is appreciated that UAVs included in the plurality of UAVs may have their ADS-B receivers operability verified sequentially and/or simultaneously. It is further appreciated that in some embodiments the ADS-B receivers of the plurality of UAVs may be monitored continuously in real time with the estimated traffic environment being updated as ADS-B data is received by the plurality of UAVs.

Block 350 illustrates ADS-B receiver operability verified for each of the plurality of UAVs upon completion of the loop associated with blocks 315 through 345. It is appreciated that in some embodiments block 350 may proceed to block 305 (e.g., to obtain additional observed traffic data, update the estimated traffic environment, and continue monitoring the ADS-B receivers of the plurality of UAVs).

FIG. 4 illustrates a functional block diagram of a computing system 400 including a plurality of UAVs 401 (e.g., 401-1, 401-2, 401-3, . . . , 401-N), an external computing device 461, and an optional third party data provider 495, in accordance with an embodiment of the disclosure. Computing system 400 is one possible system that may implement any of flow chart 200 illustrated in FIG. 2 and flow chart 300 illustrated in FIG. 3 to achieve ADS-B receiver operability verification.

In the depicted embodiment of FIG. 4, each of the plurality of UAVs 401 (e.g., first UAV 401-1) includes power system 403, communication system 405, control circuitry 407, propulsion unit 409 (e.g., one or more propellers, engines, and the like to position UAV 401), image sensor 411 (e.g., one or more CMOS or other type of image sensor and corresponding lenses to capture images of the service area), other sensors 413 (e.g., inertial measurement unit to determine pose information of the UAV, LIDAR camera, radar, and the like), data storage 415, and payload 417 (e.g., to collect and/or receive parcels, goods, and the like). The power system 403 includes charging circuitry 419 and battery 421. The communication system 405 includes GNSS receiver 423 and antenna 425, and ADS-B receiver 427 (e.g., an ADS-B In only receiver). The control circuitry 407 includes controller 429 and machine readable storage medium 433. The controller 429 includes one or more processors 431 (e.g., application specific processor, field-programmable gate array, central processing unit, graphic processing unit, tensor processing unit, and/or a combination thereof). The machine readable storage medium 433 includes program instructions 433 and may include additional instructions corresponding to a traffic estimator 437 and ADS-B health monitor 439. The data storage 415 includes an estimated traffic environment 441 (e.g., received from external computing device 461, generated by execution of traffic estimator 437, or combinations thereof) and ADS-B data 443 (e.g., logged ADS-B messages obtained by ADS-B receiver 427 and/or additional ADS-B data received from other UAVs included in the plurality of UAVs 401). Each of the components of UAV 401 may be coupled (e.g., electrically) to one another via interconnects 450.

The power system 403 provides operating voltages to communication system 405, control circuitry 407, propulsion unit 409, image sensor 411, other sensors 413, data storage 415, and any other component of UAV 401. The power system 403 includes charging circuitry 419 and battery 421 (e.g., alkaline, lithium ion, and the like) to power the various components of the UAV 401. Battery 421 may be charged directly (e.g., via an external power source), inductively (e.g., via antenna 425 functioning as an energy harvesting antenna) with charging circuitry 419, and/or may be replaceable within the UAV 401 upon depletion of charge.

The communication system 405 provides communication hardware and protocols for wireless communication with external computing device 461 (e.g., via antenna 405) and sensing of geo-spatial positioning satellites to determine the UAV 401 coordinates and altitude (e.g., via GPS, GLONASS, Galileo, BeiDou, or any other global navigation satellite system). Representative wireless communication protocols include, but are not limited to, Wi-Fi, Bluetooth, LTE, 5G, and the like. The ADS-B receiver 427 may be coupled to antenna 425 or include a separate antenna to receive ADS-B messages broadcast by aircraft within a reception range of the ADS-B receiver 427.

The control circuitry 407 includes the controller 429 coupled to machine readable storage medium 433, which includes program instructions 435, traffic estimator 437, and ADS-B health monitor 439. When the program instructions 435, traffic estimator 437, and/or ADS-B health monitor 439 are executed by the controller 429, the system 400 is configured to perform operations. The program instructions 435, for example, may choreograph operation of the components of the UAV 401 to deliver a parcel. In some embodiments, execution of the traffic estimator 437 may cause the system 400 to estimate the traffic environment of the service area and execution of the ADS-B health monitor 439 may cause the system 400 to verify operability of the ADS-B receiver 427, in accordance with embodiments of the disclosure. It is appreciated that control circuitry 407 may not show all logic modules, program instructions, or the like, all of which may be implemented in software/firmware executed on a general purpose microprocessor, in hardware (e.g., application specific integrated circuits), or a combination of both.

In some embodiments UAV 401 may be wirelessly (e.g., via communication link 499) coupled to external computing device 461 to provide external computational power via processor 463, access data storage 469, which may include an estimated traffic environment 471 of the service area, ADS-B data 473 received from the plurality of UAVs 401, and aggregated third party ADS-B data 475 received from third party data provider 495. External computing device 461 includes antenna 465 for communication with the plurality of UAVs 401. Processor 463 to choreograph operation of external computing device 461 based on program instructions 477, traffic estimator 479, and ADS-B health monitor 481 included in machine readable storage medium 467. For example, external computing device 461 may be configured to receive the ADS-B data 443 of each of the plurality of UAVs 401 and generate the estimated traffic environment 471 in accordance with embodiments of the disclosure. In some embodiments, external computing device 461 may further be configured to transmit the estimated traffic environment 471 to the plurality of UAVs 401 as estimated traffic environment 441 (e.g., such that the plurality of UAVs may autonomously perform the ADS-B receiver health check via ADS-B health monitor 439). In the same or other embodiments, execution of ADS-B health monitor 481 may cause external computing device 461 to monitor the ADS-B receiver 427 of each of the plurality of UAVs 401 and transmit a verification signal periodically to each of the plurality of UAVs to indicate whether the ADS-B receiver 427 is operating in a nominal or subnominal state.

It is appreciated that the data storage 415, machine readable storage medium 433, machine readable storage medium 467, and data storage 469 are non-transitory machine-readable storage mediums that may include, without limitation, any volatile (e.g., RAM) or non-volatile (e.g., ROM) storage system readable by components of system 400. It is further appreciated that system 400 may not show all logic modules, program instructions, or the like. All of which may be implemented in software/firmware executed on a general purpose microprocessor, in hardware (e.g., application specific integrated circuits), or a combination of both.

It should be understood that references herein to an "unmanned" aerial vehicle or UAV can apply equally to autonomous and semi-autonomous aerial vehicles. In a fully autonomous implementation, all functionality of the aerial vehicle is automated; e.g., pre-programmed or controlled via real-time computer functionality that responds to input from various sensors and/or predetermined information. In a semi-autonomous implementation, some functions of an aerial vehicle may be controlled by a human operator, while other functions are carried out autonomously. Further, in some embodiments, a UAV may be configured to allow a remote operator to take over functions that can otherwise be controlled autonomously by the UAV. For example, in some embodiments, the functions may include operating a mechanical system for picking up objects, a gimbal and camera for taking aerial photos, or the like. Yet further, a given type of function may be controlled remotely at one level of abstraction and performed autonomously at another level of abstraction. For example, a remote operator may control high level navigation decisions for a UAV, such as specifying that the UAV should travel from one location to another (e.g., from a warehouse in a suburban area to a delivery address in a nearby city), while the UAV's navigation system autonomously controls more fine-grained navigation decisions, such as the specific route to take between the two locations, specific flight control inputs to achieve the route and avoid obstacles while navigating the route, and so on.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An unmanned aerial vehicle (UAV), comprising:

an automatic dependent surveillance-broadcast (ADS-B) receiver configured to receive ADS-B data representative of ADS-B messages broadcast by traffic within a reception range of the ADS-B receiver during a first period of time; and a controller coupled to the ADS-B receiver and a machine readable storage medium, the machine readable storage medium including instructions that, when executed by the UAV cause the UAV to perform operations, comprising:

receiving additional traffic data different from the ADS-B data, the additional traffic data representative, at least in part, of the traffic within the first period of time;

estimating a traffic environment for a service area spanning, at least in part, a first operating area of the UAV during the first period of time, wherein the traffic environment is estimated based, at least in part, on the ADS-B data obtained by the UAV and the additional traffic data;

determining an expected observed traffic of the UAV during the first period of time based on the estimated traffic environment;

comparing the expected observed traffic of the UAV with the traffic associated with the ADS-B data received by the ADS-B receiver of the UAV; and instructing the UAV to perform an action when the expected observed traffic of the UAV is different from the traffic associated with the ADS-B data obtained by the UAV.

2. The UAV of claim 1, wherein the action includes at least one of adjusting a flight path of the UAV, immediately landing the UAV, or adding a stop to a launch site or a repair center for repairs.

3. The UAV of claim 1, wherein the ADS-B receiver is an ADS-B In only receiver, and wherein the UAV does not include an ADS-B Out capable transponder.

4. The UAV of claim 1, wherein the ADS-B messages include at least one of a unique identifier, a latitude, a longitude, an altitude, or a speed of one or more aircraft included in the traffic at one or more instances of time within the first period of time.

5. The UAV of claim 1, wherein the additional traffic data corresponds to additional ADS-B data obtained by a plurality of ADS-B receivers, each associated with a different respective UAV included in a plurality of UAVs operating proximate to or within the service area during the first period of time.

6. The UAV of claim 1, wherein the machine readable storage medium includes additional instructions that, when executed by the UAV, cause the UAV the perform further operations, comprising:

segmenting the additional traffic into different tracks, each of the different tracks associated with a respective data source, and wherein the different tracks further include a first track of the observed traffic associated with the ADS-B data obtained by the UAV with the ADS-B receiver; and fusing the different tracks of the observed traffic into a singular estimate of the traffic environment for the service area spanning, at least in part, the first operating area of the UAV during the first period of time.

7. The UAV of claim 1, wherein the machine readable storage medium includes additional instructions that, when executed by the UAV, cause the UAV the perform further operations, comprising:

determining one or more comparison metrics comparing the expected observed traffic and the traffic associated with the ADS-B data, and wherein the ADS-B receiver of the UAV is flagged as subnominal when at least one of the one or more comparison metrics is outside of a threshold range.

8. The UAV of claim 7, wherein the machine readable storage medium includes additional instructions that, when executed by the UAV, cause the UAV the perform further operations, comprising:

identifying one or more aircraft, included in the estimated traffic environment, within the reception range of the ADS-B receiver of the UAV at one or more instances of time within the first period of time based, at least in part, on a flight path of the UAV during the first period of time to determine the expected observed traffic of the UAV.

9. The UAV of claim 8, wherein the one or more comparison metrics includes:

a difference between a total number of aircraft expected to be observed by the UAV based on the one or more aircraft identified and an actual total number of aircraft observed based on the traffic associated with the ADS-B data; or a difference between an expected observation duration of each of the one or more aircraft identified from the estimated traffic environment and an actual observation duration of the one or more aircraft determined from the ADS-B data.

10. An external computing device, comprising:

an antenna to receive ADS-B data representative of ADS-B messages broadcast by traffic within a reception range of an ADS-B receiver included in an unmanned aerial vehicle (UAV) during a first period of time; and one or more processors coupled to the antenna and a machine readable storage medium, the machine readable storage medium including instructions that, when executed by the external computing device, cause the external computing device to perform operations, including:

receiving additional traffic data different from the ADS-B data, the additional traffic data representative, at least in part, of the traffic within the first period of time;

estimating a traffic environment for a service area spanning, at least in part, a first operating area of the UAV during the first period of time, wherein the traffic environment is estimated based, at least in part, on the ADS-B data obtained by the UAV and the additional traffic data;

determining an expected observed traffic of the UAV during the first period of time based on the estimated traffic environment;

comparing the expected observed traffic of the UAV with the traffic associated with the ADS-B data received by the ADS-B receiver of the UAV; and transmitting instructions to the UAV to perform an action when the expected observed traffic of the UAV is different from the traffic associated with the ADS-B data obtained by the UAV.

11. The external computing device of claim 10, wherein the action transmitted to the UAV includes at least one of adjusting a flight path of the UAV, immediately landing the UAV, or adding a stop to a launch site or a repair center for repairs.

12. The external computing device of claim 10, wherein the ADS-B messages include at least one of a unique identifier, a latitude, a longitude, an altitude, or a speed of one or more aircraft included in the traffic at one or more instances of time within the first period of time.

13. The external computing device of claim 10, wherein the additional traffic data corresponds to additional ADS-B data obtained by a plurality of ADS-B receivers, each associated with a different respective UAV included in a plurality of UAVs operating proximate to or within the service area during the first period of time.

14. The external computing device of claim 10, wherein the machine readable storage medium includes additional instructions that, when executed by the external computing device, cause the external computing device to the perform further operations, comprising:

segmenting the additional traffic into different tracks, each of the different tracks associated with a respective data source, and wherein the different tracks further include a first track of the observed traffic associated with the ADS-B data obtained by the UAV with the ADS-B receiver; and fusing the different tracks of the observed traffic into a singular estimate of the traffic environment for the service area spanning, at least in part, the first operating area of the UAV during the first period of time.

15. The external computing device of claim 10, wherein the machine readable storage medium includes additional instructions that, when executed by the external computing device, cause the external computing device to the perform further operations, comprising:

determining one or more comparison metrics comparing the expected observed traffic and the traffic associated with the ADS-B data, and wherein operability of the ADS-B receiver of the UAV is flagged as subnominal when at least one of the one or more comparison metrics is outside of a threshold range.

16. The external computing device of claim 15, wherein the machine readable storage medium includes additional instructions that, when executed by the external computing device, cause the external computing device to the perform further operations, comprising:

identifying one or more aircraft, included in the estimated traffic environment, within the reception range of the ADS-B receiver of the UAV at one or more instances of time within the first period of time based, at least in part, on a flight path of the UAV during the first period of time to determine the expected observed traffic of the UAV, and wherein the one or more comparison metrics includes:

a difference between a total number of aircraft expected to be observed by the UAV based on the one or more aircraft identified and an actual total number of aircraft observed based on the traffic associated with the ADS-B data; or a difference between an expected observation duration of each of the one or more aircraft identified from the estimated traffic environment and an actual observation duration of the one or more aircraft determined from the ADS-B data.

17. A non-transitory computer-readable medium having logic stored thereon that, in response to execution by one or more processors of a computing system, cause the computing system to perform operations, comprising:

receiving automatic dependent surveillance-broadcast (ADS-B) data obtained by an ADS-B receiver included in an unmanned aerial vehicle (UAV), the ADS-B data representative of ADS-B messages broadcast by traffic within a reception range of the ADS-B receiver during a first period of time;

estimating a traffic environment for a service area spanning, at least in part, a first operating area of the UAV during the first period of time, wherein the traffic environment is estimated based, at least in part, on the ADS-B data obtained by the UAV and additional traffic data different from the ADS-B data;

identifying an expected observed traffic of the UAV during the first period of time based on the estimated traffic environment;

performing a health check of the ADS-B receiver of the UAV by comparing the expected observed traffic of the UAV with the traffic associated with the ADS-B data received by the ADS-B receiver of the UAV, wherein the performing the health check includes:

calculating one or more comparison metric between the expected observed traffic and the traffic associated with the ADS-B data; and instructing the UAV to perform an action when at least one of the one or more comparison metrics is outside of a threshold range.

* * * * *